US006756346B1

(12) United States Patent
Baba et al.

(10) Patent No.: US 6,756,346 B1
(45) Date of Patent: Jun. 29, 2004

(54) LUBRICATING OIL COMPOSITION USEFUL IN HYDRAULIC FLUIDS

(75) Inventors: Yoshiharu Baba, Kanagawa Pref. (JP); Kiyoshi Hanyuda, Tokyo (JP)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/763,278

(22) PCT Filed: Aug. 18, 1999

(86) PCT No.: PCT/EP99/06094

§ 371 (c)(1),
(2), (4) Date: Feb. 20, 2001

(87) PCT Pub. No.: WO00/11122

PCT Pub. Date: Mar. 2, 2000

(30) Foreign Application Priority Data

Aug. 20, 1998 (JP) ..... 10-234758
Sep. 10, 1998 (EP) ..... 98307320

(51) Int. Cl.[7] ..... C10M 141/10; C10M 133/16; C10M 137/04

(52) U.S. Cl. ..... 508/433; 508/436; 508/438; 508/554

(58) Field of Search ..... 508/433, 436, 508/438, 554

(56) References Cited

U.S. PATENT DOCUMENTS

| | | | | | |
|---|---|---|---|---|---|
| 4,816,171 | A | * | 3/1989 | Horodysky | 508/554 |
| 5,536,423 | A | * | 7/1996 | Miyagawa et al. | 508/436 |
| 5,552,068 | A | * | 9/1996 | Griffith | 508/436 |
| 5,561,104 | A | * | 10/1996 | Miyagawa et al. | 508/421 |
| 5,700,764 | A | * | 12/1997 | Walters et al. | 508/338 |
| 5,773,393 | A | | 6/1998 | Adams | 508/551 |
| 5,792,733 | A | * | 8/1998 | Minami et al. | 508/422 |
| 5,902,777 | A | * | 5/1999 | Hashimoto et al. | 508/438 |
| 5,972,854 | A | * | 10/1999 | Ichihashi et al. | 508/433 |
| 6,103,675 | A | * | 8/2000 | Pyka et al. | 508/438 |

FOREIGN PATENT DOCUMENTS

| | | | |
|---|---|---|---|
| GB | 1415964 | 12/1975 | C10M/1/48 |
| WO | 93/06198 | 4/1993 | C10M/133/00 |
| WO | 94/24233 | 10/1994 | C10M/133/16 |

* cited by examiner

*Primary Examiner*—Ellen M. McAvoy

(57) ABSTRACT

A lubricating oil composition comprising (I) 100 pbw of a base oil, (II) an antiwear agent comprising (i) from 0.05 to 10 pbw of a phosphorothionate and from 0.01 to 1.0 pbw of an amine salt of phosphorus compound and/or (ii) from 0.05 to 10 pbw of a dithiophosphate, and (III) a rust preventing agent comprising from 0.01 to 1.0 pbw of an amide obtained by reacting a polyalkylene polyamine and a carboxylic acid having from 4 to 30 carbon atoms, and the use of such lubricating composition.

8 Claims, No Drawings

LUBRICATING OIL COMPOSITION USEFUL IN HYDRAULIC FLUIDS

FIELD OF THE INVENTION

The present invention relates to a lubricating oil composition having a low ash content or an ashless lubricating oil composition, and more specifically an antiwear type lubricating oil composition in which the ash content is reduced as low as possible, is excellent in thermal oxidation stability under severe conditions of a high temperature, is excellent in lubricating properties on various hydraulic apparatuses, and does not generate sludge even when a water content or a lubricating oil containing an overbasic alkaline earth metals additive, such as an engine oil, is incorporated.

BACKGROUND OF THE INVENTION

With a hydraulic apparatus being down-sized and used at a high speed and a high pressure, an oil is being used at a high temperature of 100° C. or higher instead of the conventional temperature range of from 50 to 70° C. Therefore, the conventional oils are not sufficient in thermal oxidation stability, and involve problems in that sludge is formed due to deterioration of the oil at a high pressure and a high temperature, the lubricating performance on a hydraulic pump is deteriorated, and friction between a seal and a rod of a hydraulic cylinder becomes large to generate rapid deterioration of the seal and abnormal vibration.

On the other hand, a conventional lubricating oil containing zinc dialkyldithiophosphate as an antiwear agent exhibits good antiwear performance on a vane pump using a sliding material mainly composed of steel. However, the zinc dialkyldithiophosphate tends to accelerate wear of a copper alloy on a piston pump using a sliding material composed of various copper alloys and steel. Thus, Denison Standard in U.S. recommends lowering the operation conditions when a zinc dialkyldithiophosphate type antiwear hydraulic oil is used in a piston pump.

With a hydraulic apparatus being advanced and precise, a filter having an extremely small pore diameter of from 3 to 10 micrometer is being used in the apparatus. Therefore, a hydraulic oil is required to have excellent filtering properties. However, the conventional oil tends to clog the filter in an early stage because sludge is formed by inclusion of a water content or an alkaline earth metal salt-containing lubricating oil, such as an engine oil, which reacts with an additive contained in the hydraulic oil. Therefore, development of a lubricating oil composition capable of solving all the problems is demanded.

A non-zinc type antiwear oil composition for hydraulic operation containing no zinc dialkyldithiophosphate has been known, and particularly an antiwear composition combining tricresyl phosphate or a triaryl phosphorothionate described in British Patent No 1,415,964 with an acidic phosphoric ester amine salt or triaryl phosphate has been known.

However, such conventional non-zinc type antiwear oil compositions for hydraulic operation involve problems in that friction between a seal and a rod of a hydraulic cylinder is large, the wear resistance becomes insufficient due to a rust preventing agent used in combination, and the filtering properties are extremely deteriorated by inclusion of a slight amount of an alkaline earth metal salt.

In addition to the above-described problems, there are increasing problems of using zinc compound including the zinc dialkyldithiophosphate from the standpoint of recent environmental protection and toxicity.

An object of the invention is to provide a lubricating oil composition in which the content of ashes such as zinc is reduced to as low as possible, that is excellent in thermal oxidation stability, lubricating property, water proofing property and filtering property.

SUMMARY OF THE INVENTION

As a result of investigation by the inventors to solve the problems associated with the conventional oils, it has been found that the problems are entirely solved by combining a specific antiwear agent and a specific rust preventing agent.

The invention relates to a lubricating oil composition comprising (I) 100 parts by weight of a base oil for a lubricating oil;

(II) as an antiwear agent, (i) (a) from 0.05 to 10 parts by weight of a phosphorothionate represented by formula (1), and (b) from 0.01 to 1.0 part by weight of an amine salt of a phosphorus compound which phosphorus compound is represented by formula (2a), and/or (ii) from 0.05 to 10 parts by weight of a dithiophosphate represented by formula (3a);

(III) as a rust preventing agent, from 0.01 to 1.0 part by weight of a polyalkylene polyamide obtained by reacting (a) a polyalkylene polyamine represented by formula (4a), and (b) a carboxylic acid having from 4 to 30 carbon atoms,

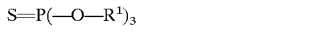

$$S{=}P(-O-R^1)_3 \quad (1)$$

(in the formula, $R^1$ represents an alkyl and/or an aryl group having from 1 to 30 carbon atoms),

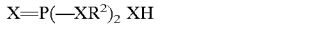

$$X{=}P(-XR^2)_2\ XH \quad (2a)$$

(in the formula, X represents a sulfur atom and/or an oxygen atom and $R^2$ represents an alkyl and/or aryl group having from 2 to 30 carbon atoms),

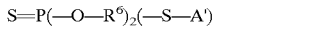

$$S{=}P(-O-R^6)_2(-S-A') \quad (3a)$$

(in the formula, $R^6$ represents an alkyl and/or aryl group having 1 to 30 carbon atoms and A' represents a hydrocarbon group optionally further containing one or more oxygen atoms),

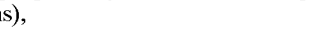

$$R^{11}(R^{12})-N(R^{10}-NR^{13})_mH \quad (4a)$$

(in the formula, $R^{10}$ represents an alkylene group having from 1 to 10 carbon atoms, $R^{11}$, $R^{12}$ and $R^{13}$ each independently represent a hydrogen atom, an alkyl group having from 1 to 30 carbon atoms and/or a hydroxyalkyl group having from 1 to 30 carbon atoms and m is an integer from 1 to 10).

Further, the present invention relates to the use of lubricating compositions according to the present invention in hydraulic operation, in gears, in turbines and/or in bearings.

DETAILED DESCRIPTION OF THE INVENTION

The technical constitution of the invention is described in detail below. The base oil component constituting the lubricating oil composition of the invention is not particularly limited, if it contains petroleum base oils and/or synthetic hydrocarbon base oils. It preferably exhibits a kinematic viscosity of from 2 to 680 $mm^2/s$ (40° C.), preferably from 5 to 320 $mm^2/s$ (40° C.), and particularly preferably from 8 to 220 $mm^2/s$ (40° C.), a total sulfur content (% by weight) of from 0 to 1%, preferably from 0 to 0.3%, a total nitrogen content (% by weight) of from 0 to 100 ppm, preferably from 0 to 30 ppm, and an aniline point of from 80 to 130° C., preferably from 100 to 125° C.

The petroleum base oil for a lubricating oil is a sole substance or a mixture of a solvent refined base oil, a hydrogenation refined base oil and a high hydrogenation decomposed base oil. The high hydrogenation decomposed base oil is a base oil for a lubricating oil having a viscosity index of 130 or more (typically from 145 to 155) obtained by such a manner that slack wax separated by solvent dewaxing as a raw material is isomerized from a linear paraffin to a branched paraffin by hydrogenolysis (catalytic cracking) in the presence of a catalyst, or a base oil for a lubricating oil having a viscosity index of 130 or more (typically from 145 to 155) obtained by such a manner that hydrogen and carbon monoxide as raw materials obtained by a gasification process (partial oxidation) of natural gas (e.g., methane) is subjected to the Fischer-Tropsch polymerization to form a heavy linear paraffin, which is then subjected to isomerization by catalytic cracking in the same manner as above.

The synthetic hydrocarbon base oil may be an olefin oligomer obtained by sole polymerization or copolymerization of a monomer selected from a linear or branched olefin hydrocarbon having from 3 to 15 carbon atoms, preferably from 4 to 12 carbon atoms.

In the invention, the petroleum base oil and the synthetic hydrocarbon base oil may be used singly or in combination as a mixture thereof.

The phosphorothionate is represented by formula (1):

$$S{=}P(-O-R^1)_3 \quad (1)$$

(in the formula, $R^1$ represents an alkyl and/or an aryl group having from 1 to 30 carbon atoms, preferably $R^1$ represents an alkyl group having from 1 to 18 carbon atoms and/or an aryl group having from 6 to 15 carbon atoms. Most preferably, $R^1$ represents a, preferably saturated, linear or branched alkyl group having from 4 to 18 carbon atoms and/or an aryl group having from 6 to 15 carbon atoms). Examples of $R^1$ include a linear or branched alkyl group, such as a linear or branched butyl group, a linear or branched pentyl group, a linear or branched hexyl group, a linear or branched heptyl group, a linear or branched octyl group, a linear or branched nonyl group, a linear or branched decyl group, a linear or branched undecyl group, a linear or branched dodecyl group, a linear or branched tridecyl group, a linear or branched tetradecyl group, a linear or branched pentadecyl group, a linear or branched hexadecyl group, a linear or branched heptadecyl group and a linear or branched octadecyl group, and an aryl group, such as a phenyl group, a linear or branched alkyl-substituted phenyl group (e.g., a methylphenyl group, an ethylphenyl group, a propylphenyl group, a butylphenyl group, a pentylphenyl group, a heptylphenyl group, an octylphenyl group, a nonylphenyl group), and a biphenyl group.

Specific examples of the compound include tributyl phosphorothionate, triisobutyl phosphorothionate, tri-2-ethylhexyl phosphorothionate, triphenyl phosphorothionate, trimethylphenyl phosphorothionate, triethylphenyl phosphorothionate, tripropylphenyl phosphorothionate, tributylphenyl phosphorothionate, trioctylphenyl phosphorothionate and trinonylphenyl phosphorothionate.

In the same molecule, both an alkyl and an aryl group can be present. Further, mixtures of trialkyl phosphorothionate and triaryl phosphorothionate can be used.

The addition amount of the phosphorothionate of formula (1) is from 0.05 to 10 parts by weight, preferably from 0.05 to 5 parts by weight, and ideally from 0.1 to 2 parts by weight, per 100 parts by weight of the base oil for a lubricating oil. When the addition amount is less than 0.05 part by weight, it is not preferred since sufficient lubricating performance cannot be obtained. When it exceeds 10 parts by weight, it is not preferred since although the lubricating performance is saturated, corrosion resistance, thermal oxidation stability and hydrolytic stability are lowered.

The amine salt of a phosphorus compound is of a phosphorus compound represented by formula (2a):

$$X{=}P(-XR^2)_2XH \quad (2a)$$

in which X represents a sulfur atom and/or an oxygen atom and $R^2$ represents an alkyl and/or aryl group having from 2 to 30 carbon atoms.

Preferably, the amine salt of the phosphorus compound is represented by $$[X{=}P(-XR^2)_2\ XH]\cdot[N(R^3R^4R^5)] \quad (2b)$$

(in the formula, X represents an atom selected from a sulfur atom and an oxygen atom, in which at least from 2 to 4 atoms represented by X are oxygen atoms, and the others may be sulfur atoms, and it is particularly preferred that at least one or two of X is/are a sulfur atom; $R^2$ represents an alkyl group having from 2 to 30 carbon atoms; $R^3$, $R^4$ and $R^5$ each represents a group independently selected from a hydrogen atom, an alkyl group having from 1 to 30 carbon atoms and a group containing from 1 to 5 mole of an alkylene oxide group; preferably, $R^3$ represents an alkyl group having from 1 to 30 carbon atoms; and preferably $R^4$ and $R^5$ each represents a group independently selected from a hydrogen atom, an alkyl group having from 1 to 30 carbon atoms and from 1 to 5 mole of an ethylene oxide group). A certain amount of related compounds, such as monoalkyl compounds, can be present. However, it is essential that the required amount of compounds according to is formula (2a) or (2b) is present. Preferably, the phosphorus compound is a phosphoric ester. The compounds can be prepared by the following method. A primary, secondary or tertiary aliphatic amine compound containing an alkyl group having from 1 to 30 carbon atoms, preferably from 1 to 18 carbon atoms, and/or from 1 to 5 mole of an ethylene oxide in the molecule is reacted with an acidic phosphoric ester and/or an acidic thiophosphoric ester, and the whole or a part of the residual acidic hydrogen is neutralized.

Examples of a linear or branched alkyl group having from 2 to 30 carbon atoms, preferably from 4 to 18 carbon atoms, include an ethyl group, a n-propyl group, an isopropyl group, a n-butyl group, an isobutyl group, a sec-butyl group, a tert-butyl group, a linear or branched pentyl group, a linear or branched hexyl group, a linear or branched heptyl group, a linear or branched octyl group, a linear or branched nonyl group, a linear or branched decyl group, a linear or branched undecyl group, a linear or branched dodecyl group, a linear or branched tridecyl group, a linear or branched tetradecyl group, a linear or branched pentadecyl group, a linear or branched hexadecyl group, a linear or branched heptadecyl group, a linear or branched octadecyl group, a linear or branched nonadecyl group, a linear or branched icosyl group, a linear or branched henicosyl group, a linear or branched docosyl group, a linear or branched tricosyl group, a linear or branched tetracosyl group, a linear or branched pentacosyl group, a linear or branched hexacosyl group, a linear or branched heptacosyl group, a linear or branched octacosyl group, a linear or branched nonacosyl group and a linear or branched triacontyl group.

Specific examples of the preferred amine compound used in the above reaction include a primary aliphatic amine (in which the alkyl group may be linear or branched), such as monomethylamine, monoethylamine, monopropylamine, monobutylamine, monopentylamine, monohexylamine, monoheptylamine, monooctylamine, monononylamine, monodecylamine, monoundecylamine, monododecylamine, monotridecylamine, monotetradecylamine, monopentadecylamine, monohexadecylamine, monoheptadecylamine, monooctadecylamine, monononadecylamine, inonoicosylamine, monohenicosylamine, monotricosylamine and monotetracosylamine, a secondary aliphatic alkylamine (in which the alkyl groups may be linear or branched), such as dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, dinonadecylamine, diicosylamine, dihenicosylamine, ditricosylamine and ditetracosylamine, and a tertiary aliphatic alkylamine (in which the alkyl groups may be linear or branched), such as trimethylamine, triethylamine, tripropylamine, tributylamine, tripentylamine, trihexylamine, triheptylamine, trioctylamine, trinonylamine, tridecylamine, triundecylamine, tridodecylamine, tritridecylamine, tritetradecylamine, tripentadecylamine, trihexadecylamine, triheptadecylamine, trioctadecylamine, trinonadecylamine, triicosylamine, trihenicosylamine, tritricosylamine, tritetracosylamine, dimethylbutylamine, dimethylpentylamine, dimethylhexylamine, dimethylheptylamine, dimethyloctylamine, dimethylnonylamine, dimethyldecylamine, dimethylundecylamine, dimethyldodecylamine, dimethyltridecylamine, dimethyltetradecylamine, dimethylpentadecylamine, dimethylhexadecylamine, dimethylheptadecylamine, dimethyloctadecylamine, dimethylnonadecylamine, dimethylicosylamine, dimethylhenicosylamine, dimethyltricosylamine, dimethyltetracosylamine, diethyloctylamine, diethylnonylamine, diethyldecylamine, diethylundecylamine, diethyldodecylamine, diethyltridecylamine, diethyltetradecylamine, diethylpentadecylamine, diethylhexadecylamine, diethylheptadecylamine, diethyloctadecylamine, diethylnonadecylamine and diethylicosylamine. Furthermore, examples of an amine added with ethylene oxide include a secondary or tertiary amine as a product obtained by adding from 1 to 5 mole of ethylene oxide to monooctylamine, monononylamine, monodecylamine, monoundecylamine, monododecylamine, monotridecylamine, monotetradecylamine, monopentadecylamine, monohexadecylamine, monoheptadecylamine, monooctadecylamine, monononadecylamine, monoicosylamine, monohenicosylamine, monotricosylamine or monotetracosylamine (in which the alkyl groups may be linear or branched).

Among these aliphatic amines, an alkylamine having from 6 to 24 carbon atoms and an alkylamine having from 6 to 24 carbon atoms added with from 1 to 2 mole of ethylene oxide are preferably used as the amine compound from the standpoint in that a lubricating oil composition excellent in wear resistance and corrosion prevention performance. When the acidic phosphoric ester and/or the acidic thiophosphoric ester contains a branched alkyl group, an alkylamine for neutralization may contain either a linear alkyl group or a branched alkyl group. When the acidic phosphoric ester and/or the acidic thiophosphoric ester contains a linear alkyl group, an alkylamine for neutralization preferably contains a branched alkyl group from the standpoint of solubility in the base oil.

The addition amount of the amine salt of the acidic phosphoric ester and/or the acidic thiophosphoric ester, i.e., the neutralized product of an amine, is from 0.01 to 1 part by weight, preferably from 0.01 to 0.2 part by weight, per 100 parts by weight of the base oil for a lubricating oil. When the addition amount is less than 0.01 part by weight, sufficient lubricating property cannot be obtained. When it exceeds 1 part by weight, the lubricating performance is saturated, but corrosion resistance, thermal oxidation stability and hydrolytic stability are lowered. Particularly, in the case where $R^2$ is a linear alkyl group, when the addition amount exceeds 0.1 part by weight, the filtering property is extremely deteriorated on inclusion of a lubricating oil containing an alkaline earth metal salt.

The dithiophosphate is represented by formula (3a)

$$S{=}P(-O-R^6)_2(-S-A') \quad (3a)$$

(in the formula, $R^6$ represents an alkyl and/or an aryl group having 1 to 30 carbon atoms and A' represents a hydrocarbon group optionally further containing one or more oxygen atoms).

Preferably the dithiophosphate is represented by formula (3b)

$$S{=}P(-O-R^6)_2(-A)$$

(in the formula, $R^6$ represents an aryl group having from 6 to 12 carbon atoms or an alkyl group having from 1 to 30 carbon atoms, and A represents a group independently selected from $$SR^7$$

$$S-C_nH_2C(O)OR^8$$

and $$S-C_nH_{2n}CH[C(O)OR^8]CH_2C(O)OR^9$$

and $R^7$, $R^8$ and $R^9$ each represents a group independently selected from an alkyl group having from 1 to 30 carbon atoms, and n is an integer from 0 to 10. preferably, $R^6$, $R^7$, $R^8$ and $R^9$ each represents a group independently selected from an alkyl group having from 1 to 8 carbon atoms, and n is an integer from 0 to 10, preferably from 0 to 6). Specific examples of the alkyl group having from 1 to 8 carbon atoms represented by $R^6$, $R^7$, $R^8$ and $R^9$ include an ethyl group, a n-propyl group, an isopropyl group, a n-butyl group, an isobutyl group, a sec-butyl group, a tert-butl group, a linear or branched pentyl group, a linear or branched hexyl group, a linear or branched heptyl group and a linear or branched octyl group.

Specific examples of the compound include a trialkyl dithiophosphate, such as tripropyl dithiophosphate, tributyl dithiophosphate, tripentyl dithiophosphate, trihexyl dithiophosphate and trioctyl dithiophosphate, and an O,O-dialkyl dithiophosphoryl-alkylenealkyl carboxylate, such as Irgalube 63 (produced by Ciba Specialty Chemicals, Inc.), Vanlube 727 and Vanlube 7611 (produced by Vanderbilt Co., Ltd.).

The addition amount of the trialkyl dithiophosphate used in the invention is from 0.05 to 10 parts by weight, preferably from 0.1 to 1 part by weight, per 100 parts by weight of the base oil for a lubricating oil. When the addition amount is less than this range, sufficient lubricating performance cannot be obtained. When the addition amount exceeds this range, the lubricating performance is saturated, but corrosion resistance, thermal oxidation stability and hydrolytic stability are lowered.

The polyalkylene polyamine is represented by formula (4a):

$$R^{11}(R^{12})—N—(R^{10}—NR^{13})_mH \quad (4a)$$

(in the formula, $R^{10}$ represents an alkylene group having from 1 to 10 carbon atoms, $R^{11}$, $R^{12}$ and $R^{13}$ each independently represents a hydrogen atom, an alkyl group having from 1 to 30 carbon atoms, preferably from 1 to 10, and/or a hydroxy alkyl group having from 1 to 30 carbon atoms, preferably from 1 to 10, and m is an integer from 1 to 10).

Preferably, $R^{10}$ represents an alkylene group having from 2 to 6 carbon atoms, and $R^{11}$, $R^{12}$ and $R^{13}$ each independently represents a hydrogen atom and/or an alkyl group having from 1 to 10 carbon atoms.

Most preferably, the polyalkylene polyamine is represented by formula (4b)

$$H_2N—(R^{10}—NH)_mH \quad (4b)$$

(in the formula, $R^{10}$ represents an alkylene group having from 2 to 4 carbon atoms, and m is an integer from 2 to 6) include diethylene triamine, triethylene tetramine, tetraethylene pentamine, pentaethylene hexamine, hexaethylene heptamine, tetrapropylene pentamine and hexabutylene heptamine.

The carboxylic acid to be reacted with the polyalkylene polyamine can be any suitable carboxylic acid containing at least one carboxylic acid group and containing in total from 4 to 30 carbon atoms, preferably from 12 to 30 carbon atoms. Examples of suitable acids containing more than one carboxylic acid group, are succinic acid and adipic acid. Preferably, the carboxylic acid is a monocarboxylic acid. Most preferably, the acid is a monocarboxylic acid selected from a saturated monocarboyxlic acid having from 12 to 30 carbon atoms and an unsaturated monocarboyxlic acid having from 18 to 24 carbon atoms.

The use of carboxylic acid includes single use of an unsaturated fatty acid, single use of a branched saturated fatty acid, combination use of an unsaturated fatty acid and a branched saturated fatty acid, and combination use of a branched saturated fatty acid and a linear saturated fatty acid. Specific examples of the unsaturated fatty acid include a monocarboxylic acid having from 18 to 24 carbon atoms, such as oleic acid, elaidic acid, cetoleic acid, erucic acid and brassidic acid. Specific examples of the branched saturated fatty acid include a monocarboxylic acid having from 18 to 30 carbon atoms, such as 2-methylheptadecanoic acid, 16-methylheptadecanoic acid, 2-octadecanoic acid, 2-methyloctadecanoic acid, 10-methyloctadecanoic acid, 15-ethylheptadecanoic acid, 3-methylnonadecanoic acid, 2-butyl-2-heptylnonanoic acid, 2-ethyleicosanoic acid, 20-methylheneicosanoic acid, 3-methyltricosanoic acid, 10-methyltetracosanoic acid, 18-methyltetracosanoic acid, 13,16-dimethyltricosanoic acid, 3,13,19-trimethyltricosanoic acid and isostearic acid. Specific examples of the linear saturated fatty acid include a monocarboxylic acid having from 12 to 30 carbon atoms, such as lauric acid, myristic acid, palmitic acid, stearic acid, arachic acid, behenic acid, lignoceric acid, cerotic acid, montanic acid and melissic acid.

As the aliphatic monocarboxylic acid component, an aliphatic monocarboxylic acid in which the aliphatic group thereof is a linear saturated or unsaturated alkyl group is basically a main part. However, if only this aliphatic monocarboxylic acid is used, there may be a case that it fails in solubility against the base oil. Therefore, it is preferred that an aliphatic monocarboxylic acid having a branched alkyl group is partly used together, thereby adjusting the solubility. Specific examples of combinations which can be suitably employed include (1) a combination of an aliphatic monocarboxylic acid having a linear saturated alkyl group with an aliphatic monocarboxylic acid having a branched saturated alkyl group and (2) a combination of an aliphatic monocarboxylic acid having a linear unsaturated alkyl group with an aliphatic monocarboxylic acid having a branched saturated alkyl group. In these combinations, though the ratio of the linear aliphatic monocarboxylic acid to the branched monocarboxylic acid varies depending on the properties of the base oil used, it is usually from 25:75 to 100:0 by mole.

The reaction of the polyalkylene polyamine and the carboxylic acid is conducted at a temperature of from 200 to 220° C. for from 2 to 3 hours, to obtain the desired amide. An amount of the monocarboxylic acid used is preferably less than (m+1) mole per mole of the polyalkylene polyamine.

Published Japanese Patent Application No. 5-46878 discloses a composition obtained by reacting a polyalkylene polyamine with a fatty acid composed of from 20 to 100 mol % of an unsaturated monocarboxylic acid and from 80 to 0 mol % of a branched saturated monocarboxylic acid, and discloses that the storage stability and the sludge dispersion capability of the lubricating oil can be improved by the composition, so that the generation of an insoluble sticky substance can be suppressed. In general, while this kind of amide has a function of dispersing sludge insoluble in an oil formed due to deterioration of the oil as described in Examined Published Japanese Patent Application No. 39-3115 and No. 5-46878, it also has a function of dispersing water content included in the lubricating oil, and thus it tends to extremely lower the emulsification resistant property of the lubricating oil. In the invention, however, it has been found that the lowering of the emulsification resistant property can be greatly improved by the combination use of the amine salt of an acidic phosphoric ester or the amine salt of an acidic thiophosphoric ester, as a component of antiwear agent.

It has also be found that the polyamide used in the invention has high rust preventing property and a function in that friction between a rod and a seal of a hydraulic cylinder is reduced to make the operation of the cylinder smooth. In the conventional rust preventing agent of a partial ester of succinic acid, which has been used in lubricating oils for industrial machines, when a lubricating oil containing an alkaline earth metal salt such as an engine oil is included, problems may occur in that sludge is formed to clog a filter, and to adversely affect the wear preventing property of an antiwear agent and the load resisting performance of an extreme-pressure agent. However, the polyamide type rust preventing agent of the invention does not bring about such generation of sludge on inclusion of an alkaline earth metal salt, and it has been found that the combination use with the antiwear agent of the invention does not adversely affect the antiwear property and the load carrying performance.

The addition amount of the polyamide obtained by reacting the polyalkylene polyamine and the monocarboxylic acid is from 0.01 to 1 part by weight, preferably from 0.02 to 0.5 part by weight, per 100 parts by weight of the base oil for a lubricating oil. When the addition amount is less than 0.01 part by weight, the rust preventing property and the function of reducing the friction between the rod and the seal of the hydraulic cylinder are not sufficient. When it exceed 1 part by weight, it is not preferred since the lubricating performance is saturated, but emulsification resistant property is lowered.

In order to further improve the performance of the lubricating oil composition of the invention, various auxiliary additives generally used may be used depending on necessity, in addition to the necessary components. For example, known additives for lubricating oils, such as an antioxidant, a metal deactivator, an extreme-pressure agent, an oiliness agent, a defoaming agent, a viscosity index improving agent, a pour point depressing agent, a detergent dispersant, a rust preventing agent and an anti-emulsification agent.

Examples of the amine type antioxidant include a dialkyldiphenylamine, such as p,p'-dioctyldiphenylamine (Nonflex OD-3 produced by Seiko chemical Co., Ltd.), p,p'-di-a-methylbenzyldiphenylamine and N-p-butylphenyl-N-p'-octylphenylamine, a monoalkyldiphenylamine, such as mono-t-butyldiphenylamine and monooctyldiphenylamine, a bis(dialkylphenyl)amine, such as di(2,4-diethylphenyl) amine and di(2-ethyl-4-nonylphenyl)amine, an alkylphenyl-1-naphthylamine, such as octylphenyl-1-naphthylamine and N-t-dodecylphenyl-1-naphthylamine, an arylnaphthylamine, such as 1-naphthylamine, phenyl-1-naphthylamine, phenyl-2-naphthylamine, N-hexylphenyl-2-naphthylamine and N-octylphenyl-2-naphthylamine, a phenylenediamine, such as N,N'-diisopropyl-p-phenylenediamine and N,N'-diphenyl-p-phenylenediamine, and a phenothiazine, such as phenothiazine (Phenothiazine produced by Hodogaya Chemical Co., Ltd.) and 3,7-dioctylphenothiazine.

Examples of the sulfur type antioxidant include a dialkylsulfide, such as didodecylsulfide and dioctadecylsulfide, a thiodipropionic ester, such as didodecyl thiodipropionate, dioctadecyl thiodipropionate, dimyristyl thiodipropionate and dodecyloctadecyl thiodipropionate, and 2-mercaptobenzoimidazole.

Examples of the phenol type antioxidant include 2-t-butylphenol, 2-t-butyl-4-methylphenol, 2-t-butyl-5-methylphenol, 2,4-di-t-butylphenol, 2,4-dimethyl-6-tbutylphenol, 2-t-butyl-4-methoxyphenol, 3-t-butyl-4-methoxyphenol, 2,5-di-t-butylhydroquinone (Antage DBH produced by Kawaguchi Chemical Co. Ltd.), 2,6-di-t-butylphenol, a 2,6-di-t-butyl-4-alkylphenol, such as 2,6-di-t-butyl-4-methylphenol and 2,6-di-t-butyl-4-ethylphenol, a 2,6-di-t-butyl-4-alkoxyphenol, such as 2,6-di-t-butyl-4-methoxyphenol and 2,6-di-t-butyl-4-ethyoxyphenol, 3,5-di-t-butyl-4-hydroxybenzylmercapto octylacetate, an alkyl-3-(3,5-di-t-butyl-4-hydroxyphenyl)propionate, such as n-octadecyl-3-(3,5-di-t-butyl-4-hydroxyphenyl)propionate (Yoshinox SS produced by Yoshitomi Pharmaceutical Industries, Ltd.), n-dodecyl-3-(3,5-di-t-butyl-4-hydroxyphenyl)propionate and 2'-ethylhexyl-3-(3,5-di-t-butyl-4-hydroxyphenyl)propionate, 2,6-di-t-butyl-a-dimethylamino-p-cresol, a 2,2'-methylenebis(4-alkyl-6-t-butylphenol), such as 2,2'-methylenebis(4-methyl-6-t-butylphenol) (Antage W-400 produced by Kawaguchi Chemical Co., Ltd.) and 2,2'-methylenebis(4-ethyl-6-tbutylphenol) (Antage W-500 produced by Kawaguchi Chemical Co., Ltd.), a bisphenol, such as 4,4'-butylidene bis(3-methyl-6-t-butylphenol) (Antage W-300 produced by Kawaguchi Chemical Co., Ltd.), 4,4'-methylenebis(2,6-t-butylphenol) (Ionox 220AH produced by Shell Japan, Inc.), 4,4'-bis(2,6-di-t-butylphenol), 2,2-(di-p-hydroxyphenyl) propane, (Bisphenol A produced by Shell Japan, Inc.), 2,2-bis(3,5-di-t-butyl-4-hydroxyphenyl)propane, 4,4'-cyclohexylidene bis (2,6-t-butylphenol), hexamethylene glycol bis[3-(3,5-di-t-butyl-4-hydroxyphenyl)propionate] (Irganox L109 produced by Ciba Specialty Chemicals, Inc.), triethylene glycol bis[3-(3-t-butyl-4-hydroxy-5-methylphenyl)propionate] (Tominox 917 produced by Yoshitomi Pharmaceutical Industries, Ltd.), 2,2'-thio-[diethyl-3-(3,5-di-t-butyl-4-hydroxyphenyl)propionate] (Irganox L115 produced by Ciba Specialty Chemicals, Inc.), 3,9-bis{1,1-dimethyl-2-[3-(3-t-butyl-4-hydroxy-5-methylphenyl)propionyloxy]-ethyl}-2,4,8,10-tetraoxaspiro[5,5]undecane (Sumilizer GA80 produced by Sumitomo Chemical Industries, Ltd.), 4,4'-thiobis(3-methyl-6-t-butylphenol) (Antage RC produced by Kawaguchi Chemical Co., Ltd.) and 2,2'-thiobis(4,6-di-t-butylresorcin), a polyphenol, such as tetrakis[methylene-3-(3,5-di-t-butyl-4-hydroxyphenyl)-propionate]methane (Irganox L101 produced by Ciba Specialty Chemicals, Inc.), 1,1,3-tris(2-methyl-4-hydroxy-5-t-butylphenyl)butane (Yoshinox 930 produced by Yoshitomi Pharmaceutical Industries, Ltd.), 1,3,5-trimethyl-2,4,6-tris(3,5-di-t-butyl-4-hydroxybenzyl)-benzene (Ionox 330 produced by Shell Japan, Inc.), bis[3,3'-bis(4'-hydroxy-3'-t-butylphenyl)butylic acid]glycol ester, 2-(3',5'-di-t-butyl-4-hydroxyphenyl)methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol, a condensation product of p-t-butylphenol and formaldehyde, and a condensation product of p-t-butylphenol and acetaldehyde.

Examples of the phosphorus type antioxidant include a triarylphosphite, such as triphenylphosphite and tricresylphosphite, a trialkylphosphite, such as trioctadecylphosphite and tridecylphosphite, and tridecyltrithiophosphite.

These antioxidants may be used singly or in combination in an amount of from 0.01 to 2.0 parts by weight per 100 parts by weight of the base oil.

Examples of a metal deactivator that can be used with the composition of the invention include a benzotriazole derivative, such as benzotriazole, a 4-alkyl-benzotriazole, e.g., 4-mentyl-benzotriazole and 4-ethyl-benzotriazole, a 5-alkyl-benzotriazole, e.g., 5-methyl-benzotriazole and 5-ethyl-benzotraizole, a 1-alkyl-benzotriazole, e.g., 1-dioctylaminomethyl-2,3-benzotriazole, and a 1-alkyl-tolutriazole, e.g., 1-dioctylaminomethyl-2,3-tolutriazole; a benzoimidazole derivative, such as benzoimidazole, a 2-(alkyldithio)-benzoimidazole, e.g., 2-(octyldithio)-benzoimidazole, 2-(decyldithio)-benzoimidazole and 2-(dodecyldithio)-benzoimidazole, and a 2-(alkyldithio)-toluimidazole, e.g., 2-(octyldithio)-toluimidazole, 2-(decyldithio)-toluimidazole and 2-(dodecyldithio)-toluimidazole; an indazole derivative, such as indazole, a 4-alkyl-indazole, a 5-alkyl-indazole; a benzothiazole derivative, such as benzothiazole, a 2-mercaptobenzothiazole (Thiolite B3100 produced by Chiyoda Chemical Industries, Ltd.), a 2-(alkyldithio) benzothiazole, e.g., 2-(hexyldithio)benzothiazole and 2-(octyldithio)benzothiazole, a 2-(alkyldithio)toluthiazole, e.g., 2-(hexyldithio)toluthiazole and 2-(octyldithio) toluthiazole, a 2-(N,N-dialkyldithiocarbamyl)benzothiazole, e.g., 2-(N,N-diethyldithiocarbamyl)benzothiazole, 2-(N,N-dibutyldithiocarbamyl)benzothiazole and 2-(N,N-dihexyldithiocarbamyl)benzothiazole, and a 2-(N,N-dialkyldithiocarbamyl)toluthiazole, e.g., 2-(N,N-diethyldithiocarbamyl)toluthiazole, 2-(N,N-dibutyldithiocarbamyl)toluthiazole and 2-(N,N-dihexyldithiocarbamyl)toluthiazole; a benzoxazole derivative, such as a 2-(alkyldithio)benzoxiazole, e.g., 2-(octyldithio)benzoxazole, 2-(decyldithio)benzoxazole and 2-(dodecyldithio)benzoxazole, and a 2-(alkyldithio) toluoxazole, e.g., 2-(octyldithio)toluoxiazole, 2-(decyldithio)toluoxazole and 2-(dodecyldithio)-toluoxazole; a thiadiazole derivative, such as a 2,5-bis (alkyldithio)-1,3,4-thiadiazole, e.g., 2,5-bis(heptyldithio)-1,3,4-thiadiazole, 2,5-bis(nonyldithio)-1,3,4-thiadiazole, 2,5-bis(dodecyldithio)-1,3,4-thiadiazole and 2,5-bis (octadecyldithio)-1,3,4-thiadiazole, a 2,5-bis(N,N-dialkyldithiocarbamyl)-1,3,4-thiadiazole, e.g., 2,5-bis(N,N-diethyldithiocarbamyl)-1,3,4-thiadiazole, 2,5-bis(N,N-dibutyldithiocarbamyl)-1,3,4-thiadiazole and 2,5-bis(N,N-dioctyldithiocarbamyl)-1,3,4-thiadiazole, and a 2-N,N-dialkyldithiocarbamyl-5-mercapto-1,3,4-thiadiazole, e.g., 2-N,N-dibutyldithiocarbamyl-5-mercapto-1,3,4-thiadiazole and 2-N,N-dioctyldithiocarbamyl-5-mercapto-1,3,4-thiadiazole; and a triazole derivative, such as a 1-alkyl-2,4-triazole, e.g., 1-dioctylaminomethyl-2,4-triazole.

These metal deactivators may be used singly or in combination in an amount of from 0.01 to 0.5 parts by weight per 100 parts by weight of the base oil.

Examples of the defoaming agent include an organosilicate, such as dimethylpolysiloxane, diethylsilicate and fluorosilicone, and a non-silicone defoaming agent, such as a polyalkylacrylate. The addition amount thereof may be from 0.0001 to 0.1 part by weight per 100 parts by weight of the base oil, and they may be used singly or in combination.

Examples of the viscosity index improving agent include a non-dispersion type viscosity index improving agent, such as a polymethacrylate and an olefin copolymer, e.g, an ethylene-propylene copolymer and a styrene-diene copolymer, and a dispersion type viscosity index improving agent, such as polymers obtained by copolymerizing these polymers with a nitrogen-containing monomer. The addition amount thereof may be from 0.05 to 20 parts by weight per 100 parts by weight of the base oil.

Examples of the pour point depressing agent include a polymethacrylate type polymer. The addition amount thereof may be from 0.01 to 5 parts by weight per 100 parts by weight of the base oil.

Examples of the detergent dispersant include a metallic detergent, such as a neutral or basic alkaline earth metal sulfonate, alkaline earth metal phenate and alkaline earth metal salicylate, and an ashless dispersant, such as an alkenylsuccinimide, an alkenyl succinic acid ester, and a modified product with a boron compound or a sulfur compound. The addition amount thereof may be from 0.01 to 1 part by weight per 100 parts by weight of the base oil, and they may be used singly or in combination.

Examples of the extreme-pressure agent and the oiliness agent include a sulfur extreme-pressure agent, such as a dialkylsulfide, dibenzylsulfide, a dialkylpolysulfide, dibenzylsulfide, an alkylmercaptane, dibenzothiophene and 2,2'-dithiobis(benzothiazole), a phosphorus extreme-pressure agent, such as a trialkyl phosphate, a triaryl phosphate, a trialkyl phosphonate, a trialkyl phosphite, a triaryl phosphite, a dialkyl hydrogenphosphite and a trialkyl trithiophosphite, an aliphatic oiliness agent, such as a fatty acid amide and a fatty acid ester, and an amine oiliness agent, such as a primary, secondary or tertiary alkylamine and an alkyleneoxide-added alkylamine. These extreme-pressure agent and oiliness agent may be used singly or in combination in an amount of from 0.1 to 2 parts by weight per 100 parts by weight of the base oil.

Sufficient rust preventing performance can be obtained by using only the composition of the invention in most cases. In the case where further rust preventing performance is required depending on the use conditions, an N-alkylsarcosinic acid, an alkylate phenoxyacetic acid, an imidazoline, K-Corr 100 produced by King Industries, Ltd. and its alkaline earth metal salt or amine salt, an N-acyl-N-alkoxyalkylasparaginic acid ester described in Unexamined Published Japanese Patent Application No. 6-200268 and an alkaline earth metal salt of a phosphoric acid ester described in EP0801116A1 can be used without deterioration of the filtering property on inclusion of an alkaline earth metal salt. These rust preventing agents may be used singly or in combination in an amount of from 0.01 to 2 parts by weight per 100 parts by weight of the base oil.

Examples of the anti-emnulsification agent include those generally used as an additive for a lubricating oil. The addition amount thereof may be from 0.0005 to 0.5 part by weight per 100 parts by weight of the base oil.

The lubricating oil composition of the invention is ideally used as an oil composition for hydraulic operation. However, it is also useful for other uses, such as an oil composition for tooth gears, an oil composition for a compressor, an oil composition for a turbine and an oil composition for a bearing.

EXAMPLES

The oil for hydraulic operation according to the invention is further described in more detail by referring to the following examples, the invention is not construed as being limited thereto. A hydrogenation refined base oil having a kinematic viscosity of 31 $mm^2/s$ at 40° C. was used as a base oil, and the following components were added thereto, to prepare a base lubricating oil composition containing no antiwear agent or rust preventing agent. The antiwear agents and the rust preventing agents shown in Table 1 for examples and those shown in Tables 2 and 3 for comparative examples were added to the base lubricating oil composition, to prepare sample oils having a kinematic viscosity of 32 $mm^2/s$ at 40° C. The amounts of the components added to the sample oils of Examples 1 to 5 and Comparative Examples 1 to 8 are expressed in terms of part by weight.

Base Lubricating Oil Composition

| | |
|---|---|
| Hydrogenation refined base oil<br>Kinematic viscosity: 31 $mm^2/s$ at 40° C. | 92.27 parts by weight |
| Amine antioxidant (N-p-butylphenyl-N-p'-octylphenyl)-amine | 0.1 part by weight |
| Phenol antioxidant (Hitec4733 produced by Ethyl Corp.) | 0.5 parts by weight |
| Benzotriazole metal deactivator (Irgamet 39 produced by) Ciba Specialty Chemicals, Inc.) | 0.1 part by weight |
| Thiadiazole metal deactivator (Elco 461 produced by Oronite Corp.) | 0.05 part by weight |

The lubricating oil compositions according to the invention (Examples 1 to 5) and for comparison, the lubricating oil compositions not containing Component (A) (Comparative Example 1), not containing Component (B) (Comparative Example 2) or not containing Component (C)

(Comparative Examples 3 and 4) were prepared by using the compositions shown in Tables 1 and 2. Furthermore, the lubricating oil compositions containing the conventional antiwear agents and rust preventing agents instead of the combination of the antiwear agent and the rust preventing agent of the invention (Comparative Examples 5 to 8) were prepared by using the compositions shown in Table 3. The various performance evaluation experiments described below were conducted for these Examples and Comparative Examples. The results obtained are shown in Tables 4 to 6. For comparison, the same performance evaluation experiments were conducted for the commercially available zinc type antiwear oil for hydraulic operation and non-zinc type oil for hydraulic operation (Comparative Examples 9 and 10). The results obtain are also shown in Table 7. In the Examples and Comparative Examples, various performance evaluation tests were carried out in the following manner.

Filtering Property Test

The occurrence of clogging of a filter on inclusion of water or an overbasic metallic salt was evaluated. 0.15 g of calcium salicylate (calcium content: 6.0% by weight, total base number: 160 mgKOH/g) as an overbasic metallic salt and 0.3 g of water were mixed with 300 g of the sample oil at room temperature, and after sealing, it was allowed to stand in an incubator at 70° C. for 96 hours and then at room temperature for 24 hours. 300 ml of the sample oil containing water and the overbasic basic metallic salt was filtered through a membrane filter having a pore diameter of 1.2 micrometer (47 mm in diameter) at a differential pressure of 660 mmHg, and a filtering time (second) required for filtering was measured. A time (second) required for filtering 300 ml of the sample oil containing no water or overbasic metallic salt was also measured, and the ratio of the filtering time of the sample oil containing water and the overbasic metallic salt to the filtering time of the sample oil containing no water or overbasic metallic salt was obtained. When the ratio exceeds twice, there is a tendency that a filter is clogged in an early stage in a practical hydraulic apparatus.

Rust Prevention Test

In order to evaluate the rust preventing performance of the sample oils, a rust prevention test was conducted in an artificial sea water at 60° C. for 24 hours according to ASTM D665, and a steel test piece was examined whether or not rust was formed. In German Standard DIN51524 (part 2), it is required that no rust is formed on this test.

Anti-emulsification Test

The water-separation property of the sample oils was evaluated according to ASTM D1401. 40 ml of the sample oil and 40 ml of pure water were placed in a test tube and stirred at 54° C. for 5 minutes. Then, a time (minute) required for completely separating water and the oil was measured. In LH03-1-94 of GM (General Motors) Standard, it is required that the time for separating the oil from water is 30 minutes or less.

Thermal Stability Test

The thermal stability of the sample oils was evaluated according to the standard for purchasing lubricating oils by Cincinnati Milacron , Inc. (U.S.) (10-SP-80160-3). An iron rod and a copper rod as catalysts were immersed in 200 ml of the sample oil, which was allowed to stand in an oven at 135° C. for 168 hours, and the sample oil was filtered through a membrane filter having a pore diameter of 8 micrometer, to measure the weight of sludge formed. According to the P-68, P-69 and P-70 Standards of an oil defined by Cincinnati Milacron , Inc., it is required that the amount of sludge is 25 mg or less per 100 ml.

Oxidation Stability Test

The oxidation stability of the sample oils was evaluated according to ASTM D4310. A coil of iron and a coil of copper as catalysts were immersed in 300 ml of the sample oil. 60 ml of water was further added, and 3 liters per minute of oxygen was blown into the sample oil at 95° C., to conduct an oxidation test for 1,000 hours. After completion of the test, the sample oil was filtered through a membrane filter having a pore diameter of 5 micrometer, to measure the weight of sludge formed. Furthermore, in order to evaluate the corrosiveness of the sample oil on copper and iron, the contents (mg) of copper and iron in the oil phase, the water phase and the sludge after the test were measured by an emission spectral analysis. According to the standard for an oil for hydraulic operation defined by Denison Corp., it is required that the amount of sludge formed is 200 mg or less in HF-0 and 100 mg or less in HF-1, and the amount of copper corroded and the amount of iron corroded are both 50 mg or less.

Hydrolytic Stability Test

The hydrolytic stability of the sample oils was evaluated according to ASTM D2619. A copper plate as a catalyst was immersed in a bottle containing 75 ml of the sample oil and 25 ml of water, and after sealing, the bottle was rotated at 93° C. for 48 hours. After completion of the test, the weight loss of the copper plate and the acid value of the water phase were measured. According to Standard HF-0 for an oil for hydraulic operation defined by Denison Corp. and Standard LB-03-1-94 of GM (General Motors), it is required that the weight loss of the copper plate is 0.2 mg/cm$^2$ or less, and the acid value of the water phase is 4 mgKOH or less.

EFZG Gear Test

The lubricating performance of the sample oils for a gear apparatus was evaluated according to ISO/WD14635-1. Operation was conducted by using Gear A at an initial oil temperature of 90° C. and a rotation number of motor of 1,450 rpm for 15 minutes for each step of load, and with increasing the step of load, the step of load, at which seizing was formed on the tooth surface of the test gear, was measured. According to the German Standard DIN51524 (part 2), it is required for an antiwear oil for hydraulic operation that the step of load, at which seizing is formed, is the tenth step or higher.

Urethane Seal Friction Test

The friction property of the sample oils between a rod and an urethane seal of a hydraulic cylinder was evaluated by using a slip-stick testing apparatus of Cincinnati Milacron, Inc. (former ASTM D2877). The sample oil was coated between a steel test piece and an urethane test piece (U801 produced by NOK), and the kinetic friction coefficient was measured at a sliding speed of 1.27 mm/min. and a load of 22.4 kgf. In a lubricating oil exhibiting a kinetic friction coefficient exceeding 0.6, friction between a seal and a rod of a practical hydraulic cylinder becomes large, and problems upon use, such as rapid deterioration of the seal and abnormal vibration, occur.

Vane Pump Test

The wear preventing performance of the sample oils for a vane pump was evaluated by using Vickers 35VQ-25A pump. The pump test was conducted at an oil temperature of 65° C., a rotation number of 2,400 rpm and a pressure of 210 kgf/cm$^2$ for 50 hours, the wear amounts of the vane and the ring after the test were measured. According to M-2950-S Standard defined by Vickers Corp., it is required that the wear amount is 90 mg or less.

[Piston Pump Test]

While a vane and a ring as main sliding members in a vane pump are composed of steel, main sliding members in a piston pump are usually composed of steel and a copper alloy. Therefore, in a vane pump, the antiwear property of a lubricating oil is required for sliding between steel pairs, whereas in a piston pump, the antiwear property of a lubricating oil is required for sliding between steel and copper alloy materials. The antiwear performance of the sample oils was evaluated by using a swash plate type tandem piston pump (HPV35+35) produced by Komatsu Corp. An endurance test was conducted with applying a load to a pump of the rear side under the following conditions for 500 hours, and after completion of the test, the wear amounts (mg) of the pistons and the cylinder of the pump of the rear side were measured.

Test Conditions

Pressure Cycle:

2 seconds with no load, and 3 seconds at 320 kgf/cm$^2$

Flow Amount:

65 L/min. with no load, and 43 L/min. at 320 kgf/cm$^2$

Rotation Number: 2,100 rpm

Temperature: 95° C.

When the wear amount exceeds 1,500 mg in this test, the flow amount of the pump is lowered, and the pressure fluctuation and the noise become large. As a result, there is a danger of occurring problems in lubrication of a piston pump.

TABLE 1

| Example | 1 | 2 | 3 | 4 | 5 |
|---|---|---|---|---|---|
| Base oil composition, % by weight | 99.35 | 99.3 | 99.5 | 99.5 | 99.38 |
| Component A-1 Triphenylphosphorothionate, % by weight | 0.5 | 0.5 | 0.3 | — | 0.3 |
| Component A-2 O,O-Diisopropyl-dithiophosphorylethylpropionate, % by weight | — | — | — | 0.4 | 0.2 |
| Component B-1 Lauryl monoethanol amine salt of di-2-ethylhexyl acidic phosphoric ester, % by weight | 0.05 | — | 0.05 | — | 0.02 |
| Component B-2 Amine salt of branched C9-C12 of di-4-methyl-2-pentyldithiophosphoric acid ester, % by weight | — | 0.1 | 0.05 | — | 0.05 |
| Component C Polyamide among tetraethylene pentamine, stearic acid and isostearic acid, (molar ratio = 1:3.5/2:3.5/2) % by weight | 0.1 | 0.1 | 0.1 | 0.1 | 0.05 |

TABLE 2

| Comparative Example | 1 | 2 | 3 | 4 |
|---|---|---|---|---|
| Base oil composition, % by weight | 99.8 | 99.4 | 99.4 | 99.6 |
| Component A-1 Triphenylphosphorothionate, % by weight | — | 0.5 | 0.5 | — |
| Component A-2 O,O-Diisopropyl-dithiophosphorylethylpropionate, % by weight | — | — | — | 0.4 |
| Component B-1 Lauryl monoethanol amine salt of di-2-ethylhexyl acidic phosphoric ester, % by weight | — | — | — | — |
| Component B-2 Amine salt of branched C9-C12 of di-4-methyl-2-pentyldithiophosphoric acid ester, % by weight | 0.1 | — | 0.1 | — |
| Component C Polyamide among tetraethylene pentamine, stearic acid and isostearic acid, (molar ratio = 1:3.5/2:3.5/2) % by weight | 0.1 | 0.1 | — | — |

TABLE 3

| Comparative Example | 5 | 6 | 7 | 8 |
|---|---|---|---|---|
| Base oil composition, % by weight | 99.3 | 99.4 | 99.15 | 99.55 |
| Component A-1 Triphenylphosphorothionate, % by weight | — | 0.5 | 0.5 | — |
| Component A-2 O,O-Diisopropyl-dithiophosphorylethylpropionate, % by weight | — | — | — | 0.4 |
| Component B-1 Lauryl monoethanol amine salt of di-2-ethylhexyl acidic phosphoric ester, % by weight | — | — | — | — |
| Component B-2 Amine salt of branched C9-C12 of di-4-methyl-2-pentyldithiophosphoric acid ester, % by weight | — | — | — | — |
| Component C Polyamide among tetraethylene pentamine, stearic acid and isostearic acid, (molar ratio = 1:3.5/2:3.5/2) % by weight | — | — | — | — |
| Conventional component A | | | | |
| Dibenzyldisulfide, % by weight | 0.3 | — | — | — |
| Tricresylphosphate, % by weight | 0.3 | — | 0.3 | — |
| Conventional component B | | | | |
| Tridecyl amine salt of n-octyl acidic phosphoric ester, % by weight | 0.1 | — | — | — |
| Lauryl amine salt of methyl acidic phosphoric ester, % by weight | — | 0.05 | — | — |
| Conventional component C | | | | |
| Alkenyl succinic acid half ester, % by weight | — | 0.05 | — | — |
| N-oleylsarcosinic acid, % by weight | — | — | 0.05 | 0.05 |

TABLE 4

| Example | 1 | 2 | 3 | 4 | 5 |
|---|---|---|---|---|---|
| Filtering property test filtering time of Ca + water-added oil(s)/ filtering time of non-added oil(s) | 1.06 | 1.02 | 1.04 | 1.01 | 1.01 |

TABLE 4-continued

| Example | 1 | 2 | 3 | 4 | 5 |
|---|---|---|---|---|---|
| Rust prevention test artificial sea water, 24 hours, 60° C. | no rust | no rust | no rust | no rust | no rust |
| Emulsification resistant test time for separating water and oil (min.) | 5 | 5 | 5 | 10 | 5 |
| Thermal stability test sludge weight mg/100 ml | 2 | 4 | 2 | 5 | 4 |
| Oxidation stability test | | | | | |
| sludge weight mg | 35 | 37 | 42 | 88 | 53 |
| copper corrosion weight mg | 1 | 1 | 1 | 1 | 1 |
| iron corrosion weight mg | 1 | 1 | 1 | 15 | 2 |
| Hydrolytic stability test | | | | | |
| acid value of water phase mgKOH | 2.0 | 2.9 | 1.7 | 3.5 | 3.1 |
| weight loss of copper mg/cm$^2$ | 0.01 | 0.01 | 0.00 | 0.02 | 0.01 |
| FZG gear test damage forming load (stage) | 12 | >12 | 12 | 11 | 12 |
| Urethane seal friction test kinetic friction coefficient | 0.35 | 0.34 | 0.33 | 0.34 | 0.35 |
| Vane pump test (total wear amount of vane and ring mg) | 20 | 18 | 12 | 26 | 15 |
| Piston pump test (total wear amount of cylinder and piston mg) | 348 | 490 | 453 | 726 | 289 |

TABLE 5

| Comparative Example | 1 | 2 | 3 | 4 |
|---|---|---|---|---|
| Filtering property test filtering time of Ca + water-added oil(s)/filtering time of non-added oil(s) | 1.07 | 1.01 | 8.57 | 1.04 |
| Rust prevention test artificial sea water, 24 hours, 60° C. | no rust | no rust | no formed | no formed |
| Emulsification resistant test time for separating water and oil (min.) | 5 | 40 | 10 | 5 |
| Thermal stability test sludge weight mg/100 ml | 2 | 1 | 15 | 8 |
| Oxidation stability test | | | | |
| sludge weight mg | 33 | 28 | 250 | 1,207 |
| copper corrosion weight mg | 1 | 1 | 1 | 2 |
| iron corrosion weight mg | 1 | 1 | 203 | 413 |
| Hydrolytic stability test | | | | |
| acid value of water phase mgKOH | 2.8 | 1.0 | 3.5 | 4.2 |
| weight loss of copper mg/cm$^2$ | 0.01 | 0.01 | 0.01 | 0.02 |
| FZG gear test damage forming load (stage) | 9 | 8 | >12 | 11 |
| Urethane seal friction test kinetic friction coefficient | 0.35 | 0.35 | 1.10 | 1.20 |
| Vane pump test (total wear amount of vane and ring mg) | >250 | >250 | 25 | 31 |
| Piston pump test (total wear amount of cylinder and piston mg) | >4,000 | 884 | 647 | 1,253 |

Comparative Examples 1 and 2 could not exhibit sufficient performance in the FZG gear test and the vane pump test, and failed German standard DIN51524 (part 2) and Vickers Standard M-2950-S. In Comparative Example 1, a large amount of wear occurred in the piston pump test and had a problem in applicability to a piston pump. Comparative Example 2 involved a problem in the emulsification resisting property and failed GM Standard LH-03-1-94.

Comparative Example 3 could not exhibit sufficient performance in the filtering property test, the rust prevention test and the urethane seal friction test. In Comparative Example 3, a large amount of rust was formed in the oxidation stability test, and failed Denison Standards HF-0 and HF-1 for an oil for hydraulic operation and DIN51524 (part 2).

Comparative Example 4 could not exhibit sufficient performance in the rust prevention test, the oxidation stability test, the hydrolytic stability test and the urethane seal friction test, and failed Denison Standards HF-0 and HF-1 for an oil for hydraulic operation and DIN51524 (part 2).

TABLE 6

| Comparative Example | 5 | 6 | 7 | 8 |
|---|---|---|---|---|
| Filtering property test filtering time of Ca + water-added oil(s)/filtering time of non-added oil(s) | >10 | >10 | 1.02 | 1.04 |
| Rust prevention test artificial sea water, 24 hours, 60° C. | no rust | no rust | no rust | no rust |
| Emulsification resistant test time for separating water and oil (min.) | 10 | 10 | 5 | 5 |
| Thermal stability test sludge weight mg/100 ml | 40 | 32 | 6 | 15 |
| Oxidation stability test | | | | |
| sludge weight mg | 50 | 41 | 33 | 330 |
| copper corrosion weight mg | 2 | 2 | 4 | 5 |
| iron corrosion weight mg | 1 | 1 | 2 | 228 |
| Hydrolytic stability test | | | | |
| acid value of water phase mgKOH | 5.0 | 3.5 | 1.6 | 4.5 |
| weight loss of copper mg/cm$^2$ | 0.01 | 0.01 | 0.01 | 0.01 |
| FZG gear test damage forming load (stage) | 12 | 12 | 8 | 9 |
| Urethane seal friction test kinetic friction coefficient | 0.90 | 1.18 | 0.55 | 0.50 |
| Vane pump test (total wear amount of vane and ring mg) | 15 | 28 | >250 | 92 |
| Piston pump test (total wear amount of cylinder and piston mg) | >4,000 | 567 | 507 | 845 |

TABLE 7

| Comparative Example | 9 | 10 |
|---|---|---|
| Filtering property test filtering time of Ca + water-added oil(s)/filtering time of non-added oil(s) | 1.03 | >10 |
| Rust prevention test artificial sea water, 24 hours, 60° C. | no rust | no rust |
| Emulsification resistant test time for separating water and oil (min.) | 5 | 5 |
| Thermal stability test sludge weight mg/100 ml | 8 | 20 |

TABLE 7-continued

| Comparative Example | 9 | 10 |
|---|---|---|
| Oxidation stability test | | |
| sludge weight mg | 101 | 58 |
| copper corrosion weight mg | 120 | 1 |
| iron corrosion weight mg | 2 | 2 |
| Hydrolytic stability test | | |
| acid value of water phase mgKOH | 0.5 | 2.8 |
| weight loss of copper mg/cm$^2$ | 0.32 | 0.02 |
| FZG gear test damage forming load (stage) | 11 | 7 |
| Urethane seal friction test kinetic friction coefficient | 0.98 | 1.20 |
| Vane pump test (total wear amount of vane and ring mg) | 48 | >250 |
| Piston pump test (total wear amount of cylinder and piston mg) | 1,890 | 613 |

Comparative Example 5 did not give sufficient performances in the filtering property test, the hydrolytic stability test, the urethane seal friction test and thermal stability test, and failed P-68 Standard for a hydraulic oil by Cincinnati Milacron, Inc. and HF-0 Standard by Denison. Also, a large amount of wear was formed in the piston pump test.

Comparative Example 6 could not exhibit sufficient performance in the filtering property test and the urethane seal friction test, and failed P-68 Standard for a hydraulic oil by Cincinnati Milacron, Inc.

Comparative Example 7 could not exhibit sufficient Ad performance in the FZG gear test and the vane pump test, and failed German Standard DIN51524 (part 2) and M-2950-S Standard by Vickers.

Comparative Example 8 could not exhibit sufficient performance in the oxidation stability test, the hydrolytic stability test and the FZG gear test, and By failed HF-0 Standard and HF-1 Standard by Denison, German Standard DIN51524 (part 2) and M-2950-S Standard by Vickers.

Comparative Example 9 failed HF-0 Standard and HF-1 Standard by Denison and M-2950-S Standard by Vickers in the oxidation stability test and the hydrolytic stability test.

Comparative Example 10 involved problems in the filtering property test, the FZG gear test, the urethane seal friction test and the vane pump test and failed German Standard DIN51524 (part 2) and MS-2950-S Standard by Vickers.

It is clear from the compositions shown in Table 1 and the results shown in Table 4 that the lubricating oil composition of the invention is excellent in rust prevention property, corrosion resisting property for copper and iron, filtering property, thermal oxidation stability, antiwear property for vane and piston pumps, wear property for hydraulic cylinder, and load capacity to gear elements, and thus exhibits performance that satisfies all the required performance as an oil for hydraulic operation. On the other hand, in the case where the necessary component in the invention is lacking (Comparative Examples), and in the case of the commercially available zinc type oil and non-zinc type oil, at least one of required performance as an antiwear hydraulic oil is greatly deteriorated, and therefore gives problems for use as a lubricating oil for recent hydraulic apparatus that is down-sized, operated at a high speed and a high pressure, and is precise.

Effect of the Invention

The lubricating oil composition of the invention does not contain zinc dialkyldithiophosphate from the standpoint of environment and safety, and is excellent in lubricating property, water proofing property, filtering property and rust preventing property, including use in recent hydraulic apparatus that is down-sized, operated at a high speed and a high pressure, and is precise. Therefore, the composition of the invention satisfies all the various required performances for a hydraulic oil defined by the standards of Cincinnati Milacron, Inc., Denison, Vickers, GM and DIN, and also exhibits excellent performance in filtering property and urethane seal friction property.

What is claimed is:

1. A lubricating oil composition comprising:

(a) 100 parts by weight of a base oil for a lubricating oil;

(b) as an antiwear agent:

(i) (a) from 0.05 to 10 parts by weight of a phosphorothionate represented by formula (1),

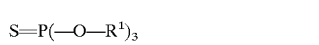

$$S{=}P(-O-R^1)_3 \quad (1)$$

wherein $R^1$ represents an alkyl and/or an aryl group having from 1 to 30 carbon atoms; and, (b) from 0.01 to 1.0 part by weight of an amine salt of a phosphorus compound which phosphorus compound is represented by formula (2a),

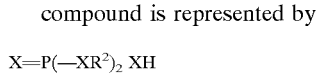

$$X{=}P(-XR^2)_2\ XH \quad (2a)$$

wherein X represents a sulfur atom and/or an oxygen atom and $R^2$ represents an alkyl and/or aryl group having from 2 to 30 carbon atoms; and/or (ii) from 0.05 to 10 parts by weight of a dithiophosphate represented by formula (3a);

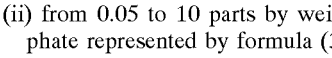

$$S{=}P(-O-R^6)_2(-S-A') \quad (3a)$$

wherein $R^6$ represents an alkyl and/or aryl group having 1 to 30 carbon atoms and A' represents a hydrocarbon group optionally further containing one or more oxygen atoms; and, (c) as a rust preventing agent:

from 0.01 to 1.0 part by weight of a polyalkylene polyamide obtained by reacting (a) a polyalkylene polyamine represented by formula (4a),

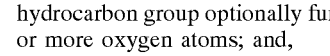

$$R^{11}(R^{12})-N(R^{10}-NR^{13})_mH \quad (4a)$$

wherein $R^{10}$ represents an alkylene group having from 1 to 10 carbon atoms, $R^{11}$, $R^{12}$ and $R^{13}$ each independently represent a hydrogen atom, an alkyl group having from 1 to 30 carbon atoms and/or a hydroxyalkyl group having from 1 to 30 carbon atoms, and m is an integer from 1 to 10; and, (b) a carboxylic acid having from 4 to 30 carbon atoms.

2. The lubricating oil composition of claim 1, in which the antiwear agent is:

(i) (a) from 0.05 to 10 parts by weight of a phosphorothionate represented by formula (1),

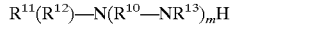

$$S{=}P(-O-R^1)_3 \quad (1)$$

wherein $R^1$ represents an alkyl group having from 1 to 18 carbon atoms and/or an aryl group having from 6 to 15 carbon atoms; and, (b) from 0.01 to 1.0 part by weight of at least one kind of an amine salt of a phosphorus compound represented by formula (2b), $$[X{=}P(-XR^2)_2XH]\cdot[N(R^3R^4R^5)] \quad (2b)$$

wherein X represents a sulfur atom or an oxygen atom, in which at least from 2 to 4 atoms represented by X are oxygen atoms, and the others may be sulfur atoms; $R^2$ represents an alkyl group having from 2 to 30 carbon atoms, $R^3$, $R^4$ and $R^5$ each represents a group independently selected from a hydrogen atom, an alkyl group having from 1 to 30 carbon atoms and from 1 to 5 mole of an alkylene oxide group; and/or, (ii) from 0.05 to 10 parts by weight of a dithiophosphate represented by formula (3b), $$S{=}P(-O-R^6)2(-A) \quad (3b)$$

wherein $R^6$ represents an aryl group having from 6 to 12 carbon atoms or an alkyl group having from 1 to 30 carbon atoms, and A represents a group independently selected from $SR^7$ $S-C_nH_{2n}C(O)OR^8$ and $S-C_nH_{2n}CH[C(O)OR^8]CH_2C(O)OR^9$ and $R^7$, $R^8$ and $R^9$ each represents a group independently selected from an alkyl group having from 1 to 30 carbon atoms, and n is an integer from 0 to 10; and, the rust preventing agent is a polyalkylene polyamide obtained by reacting (a) a polyalkylene polyamine represented by formula (4a), $$R^{11}(R^{12})-N(R^{10}-NR^{13})_mH \quad (4a)$$

wherein $R^{10}$ represents an alkylene group having from 1 to 10 carbon atoms, $R^{11}$, $R^{12}$and $R^{13}$ each independently represents a hydrogen atom, an alkyl group having from 1 to 10 carbon atoms and/or a hydroxyalkyl group having from 1 to 10 carbon atoms, and m is an integer from 1 to 10; and, (b) a carboxylic acid having from 4 to 30 carbon atoms.

3. The lubricating oil composition of claim 2, in which the antiwear agent is, (i) (a) from 0.05 to 10 parts by weight of a phosphorothionate represented by formula (1), $$S{=}P(-O-R^1)_3 \quad (1)$$

wherein $R^1$ represents an alkyl group having from 4 to 18 carbon atoms and/or an aryl group having from 6 to 15 carbon atoms; and, (b) from 0.01 to 1.0 part by weight of at least one kind of an amine salt selected from an amine salt of an acidic phosphoric ester and an amine salt of an acidic thiophosphoric ester represented by formula (2b), $$[X{=}P(-XR^2)_2XH]\cdot[N(R^3R^4R^5)] \quad (2b)$$

wherein X represents a sulfur atom or an oxygen atom, in which at least from 2 to 4 atoms represented by X are oxygen atoms, and the others may be sulfur atoms; $R^2$ represents an alkyl group having from 2 to 30 carbon atoms; $R^3$, $R^4$ and $R^5$ each represents a group independently selected from a hydrogen atom, an alkyl group having from 1 to 30 carbon atoms and from 1 to 5 mole of an alkylene oxide group; and/or, (ii) from 0.05 to 10 parts by weight of a dithiophosphate represented by formula (3b), $$S{=}P(-O-R^6)2(-A) \quad (3b)$$

wherein $R^6$ represents an alkyl group having from 1 to 8 carbon atoms, and A represents a group independently selected from $SR^7$ $S-C_nH_{2n}C(O)OR^8$ and $S-C_nH_{2n}CH[C(O)OR^8]CH_2C(O)OR^9$ and $R^7$, $R^8$ and $R^9$ each represents a group independently selected from an alkyl group having from 1 to 8 carbon atoms, and n is an integer from 0 to 10; and, in which the rust preventing agent is a polyalkylene polyamide obtained by reacting (a) a polyalkylene polyamine represented by formula (4a), $$R^{11}(R^{12})-N(R^{10}-NR^{13})_mH \quad (4a)$$

wherein $R^{10}$ represents an alkylene group having from 2 to 6 carbon atoms, $R^{11}$, $R^{12}$ and $R^{13}$ each independently represent a hydrogen atom and/or an alkyl group having from 1 to 10 carbon atoms, and m is an integer from 1 to 10; and, (b) a carboxylic acid having from 12 to 30 carbon atoms.

4. The lubricating oil composition of claim 3, in which the antiwear agent is a phosphorothionate selected from a phosphorothionate represented by formula (1), $$S{=}P(-O-R^1)_3 \quad (1)$$

wherein $R^1$ represents a saturated alkyl group having from 4 to 18 carbon atoms and/or an aryl group having from 6 to 15 carbon atoms; and, from 0.01 to 1.0 part by weight of at least one kind of an amine salt selected from an amine salt of an acidic phosphoric ester and an amine salt of an acidic thiophosphoric ester represented by formula (2b), $$[X{=}P(-XR^2)_2XH]\cdot[N(R^3R^4R^5)] \quad (2b)$$

wherein X represents an atom selected from a sulfur atom and an oxygen atom, in which at least from 2 to 4 atoms represented by X are oxygen atoms, and the others may be sulfur atoms; $R^2$ represents an alkyl group having from 2 to 30 carbon atoms; $R^3$ represents an alkyl group having from 1 to 30 carbon atoms; and $R^4$ and $R^5$ each represents a group independently selected from a hydrogen atom, an alkyl group having from 1 to 30 carbon atoms and from 1 to 5 mole of an ethylene oxide group; and/or, (iii) from 0.05 to 10 parts by weight of a trialkyl dithiophosphate represented by formula (3b), $$S{=}P(-O-R^6)2(-A) \quad (3b)$$

wherein A represents a group independently selected from $$SR^7$$

$$S-C_nH_{2n}C(O)OR^8$$

and $$S-C_nH_{2n}CH[C(O)OR^8]CH_2C(O)OR^9$$

and $R^6$, $R^7$, $R^8$ and $R^9$ each represents a group independently selected from an alkyl group having from 1 to 8 carbon atoms, and n is an integer from 0 to 6;

the rust preventing agent is a polyalkylene polyamide obtained by reacting (a) a polyalkylene polyarnine represented by formula (4b), $$H_2N-(R^{10}-NH)_mH \quad (4b)$$

wherein $R^{10}$ represents an alkylene group having from 2 to 4 carbon atoms, and m is an integer from 2 to 6; and, (b) at least one kind of a monocarboxylic acid selected from a saturated monocarboxylic acid having from 12 to 30 carbon atoms and an unsaturated monocarboxylic acid having from 18 to 24 carbon atoms.

5. A lubricating oil composition as claimed in claim 4, wherein in said amine salt of acidic phosphoric ester and said amine salt of acidic thiophosphoric ester represented by formula (2b), $R^2$ represents an alkyl group having from 4 to 18 carbon atoms; $R^3$ represents an alkyl group having from 4 to 18 carbon atoms; and $R^4$ and $R^5$ each represents a group independently selected from the group consisting of a hydrogen atom, an alkyl group having from 1 to 18 carbon atoms and from 1 to 5 mole of an ethylene oxide group.

6. A lubricating oil composition as claimed in claim 5, wherein in said amine salt of acidic phosphoric ester and said amine salt of acidic thiophosphoric ester represented by formula (2b), $R^2$ represents a branched alkyl group.

7. A lubricating oil composition as claimed in claim 6, wherein said monocarboxylic acid to be reacted with said polyalkylene polyamine represented by formula (4a) or (4b) is a mixture of aliphatic monocarboxylic acids, and said mixture is independently selected from the group consisting of a mixture of an aliphatic monocarboxylic acid in which the aliphatic group thereof is a linear saturated alkyl group having from 12 to 24 carbon atoms and an aliphatic monocarboxylic acid in which the aliphatic group thereof is a branched saturated alkyl group having from 12 to 30 carbon atoms and a mixture of an aliphatic monocarboxylic acid in which the aliphatic group thereof is a linear unsaturated alkyl group having from 18 to 24 carbon atoms and an aliphatic monocarboxylic acid in which the aliphatic group thereof is a branched saturated alkyl group having from 12 to 30 carbon atoms.

8. A lubricating oil composition as claimed in claim 7, wherein said lubricating oil composition does not generate rust on a rust preventing test; exhibit performance in that sludge formed on a thermal stability test is 25 mg/100 ml or less, sludge formed on an oxidation stability test is 100 mg or less, a corrosion amount of copper on an oxidation stability test is 50 mg or less, a weight loss of a copper plate on a hydrolytic stability test is 0.2 mg/cm$^2$ or less, an acid value of a water phase on a hydrolytic stability test is 4 mgKOH or less, a grade of a seizing formation load on an FZG gear test is grade 10 or more, and a wear amount on a vane pump test is 90 mg or less; has a kinetic friction coefficient on an urethane seal friction test of 0.6 or less; and exhibits excellent filtering properties on inclusion of water and an alkaline earth metal salt-containing lubricating oil.

* * * * *